United States Patent [19]

Preusser et al.

[11] Patent Number: 4,925,535

[45] Date of Patent: May 15, 1990

[54] PROCESS FOR THE PRODUCTION OF AN AROMATE CONCENTRATE SUITABLE FOR USE AS BLENDING COMPONENT FOR GASIFICATION FUEL

[75] Inventors: Gerhard Preusser; Gerd Emmrich, both of Essen; Martin Schulze, Velbert, all of Fed. Rep. of Germany

[73] Assignee: Krupp Koppers GmbH, Essen, Fed. Rep. of Germany

[21] Appl. No.: 230,187

[22] Filed: Aug. 8, 1988

[30] Foreign Application Priority Data

Aug. 8, 1987 [DE] Fed. Rep. of Germany ..... 3726449

[51] Int. Cl.[5] ..... B01D 3/40; C07C 7/08

[52] U.S. Cl. ..... 203/25; 203/27; 203/58; 203/74; 203/75; 203/77; 203/81; 203/82; 585/808; 585/865; 208/312; 208/313; 208/326; 208/355; 208/365

[58] Field of Search ..... 203/58, 51, 27, 25, 203/74, 75, 77, 81, 22, 82; 208/313, 312, 326, 365, 355; 585/808, 865, 804, 914, 807

[56] References Cited

U.S. PATENT DOCUMENTS

| | | | |
|---|---|---|---|
| 2,842,484 | 7/1958 | Fleck | 208/313 |
| 3,216,929 | 11/1965 | Favre | 208/312 |
| 4,410,400 | 10/1983 | Preusser et al. | 203/27 |
| 4,488,936 | 12/1984 | Preusser et al. | 203/DIG. 9 |
| 4,586,986 | 5/1986 | Preusser et al. | 203/27 |
| 4,595,491 | 6/1986 | Berns | 208/313 |

FOREIGN PATENT DOCUMENTS 3,612,384 10/1987 Fed. Rep. of Germany .

*Primary Examiner*—Wilbur Bascomb
*Attorney, Agent, or Firm*—Michael J. Striker

[57] ABSTRACT

The process for production of an aromate concentrate for use as a blending component for gasification fuel includes subjecting another feed hydrocarbon mixture to an extractive distillation using N-substituted morpholines as selective solvent in a extractive distillation column. Low-boiling non-aromates with a boiling range up to about 105° C. practically completely and higher-boiling non-aromates with a boiling range between about 105° and 160° C. to a substantial extent are discharged as a raffinate from the top of the extractive distillation column. The extract bottoms from the extractive distillation are fed to a solvent stripping column where the solvent is at least partially recovered from other hydrocarbons. To eliminate condensation and polymerization products due to components with a boiling point over 170° C. from the feed hydrocarbon mixture which can impair the process, a feed hydrocarbon mixture which contains those high boiling components is predistilled prior to extractive distillation to remove them. The top product from the predistillation column is fed to the extractive distillation column for extractive distillation. The predistillation residue can then be added to other hydrocarbons to form the aromate concentrate.

3 Claims, 1 Drawing Sheet

PROCESS FOR THE PRODUCTION OF AN AROMATE CONCENTRATE SUITABLE FOR USE AS BLENDING COMPONENT FOR GASIFICATION FUEL

BACKGROUND OF THE INVENTION

The invention concerns a process for the production of an aromate concentrate suitable for use as blending component for gasifier fuel, from feed hydrocarbon mixtures having a boiling range from between 40° to 170° C., containing in addition to non-aromates, several aromates, whereby the feed hydrocarbon mixture is subjected to an extractive distillation using N-substituted morpholines, substituents of which display no more than seven C-atoms, as selective solvent, and whereby the low-boiling non-aromates with a boiling range up to about 105° C. practically completely and the higher boiling non-aromates with a boiling range between about 105° and 160° C. predominantly are distilled off as raffinate across the top from the extractive distillation column, whereas the major amount of aromates as well as the residual non-aromates, together with the employed solvent, are discharged as extract from the sump of the extractive distillation column, whereupon the solvent is separated from the other hydrocarbons of the extract, distillatively, in a subsequently disposed solvent stripping column, and these other hydrocarbons are employed partially or completely as blending component.

A process of this type, which is not however considered state of the art, is described in DE-OS 36 12 384. This reference suggests that the feed hydrocarbon mixture is to be led into the extractive distillation column without previous separation into individual fractions.

Particularly suitable feed hydrocarbon mixtures are disclosed to be the so-called reformate and platformate from the working-up of petroleum, with not too high a content of benzene. One can, however, also employ mixtures of such reformate and platformate with pyrolysis benzenes.

Normally, the end of boiling of these entry products lies at about 170° C. In practice, however, it has turned out that this boiling end level is not maintained in many cases, since the above-described production processes causes a formation of condensation and polymerization products, which display a higher boiling point than 170° C. and which, accordingly, contaminate the reformate and platformate. Since these higher boiling condensation and polymerization products are often present in the reformate and platformate in concentrations up to about 30% by weight, they can lead to considerable impairment in performance of the processes described in DE-OS 36 12 384.

In practice, it has been proven that, namely, these condensation and polymerization products concentrate in the selective solvent, since they can only be distillatively separated from them practically not at all or incompletely. With increasing operational time, this leads to an increasingly stronger contamination of the solvent led in circulation, whereby its selectivity progressively decreases and the separation effect in the extractive distillation diminishes correspondingly.

Attempts to separate these condensation and polymerization products by means of distillation of the solvent have—as already mentioned—provided no satisfactory results, even with use of a high distillation expenditure. It has been proven, namely, that part of these condensation and polymerization products have a corresponding boiling range as the solvent, so that a distillative separation is practically impossible. Accordingly, this problem could previously be solved only by undergoing a complete exchange of the contaminated solvent after a certain period of operation. On the one hand, this technique is extremely costly and thereby impractical. On the other hand, destruction of the contaminated solvent necessitates additional costs, since it can no longer be introduced to any other employment or utilization.

The invention is therefore based upon the object of so improving the older process that the above-depicted disadvantages can be avoided.

SUMMARY OF THE INVENTION

This object is attained according to the present invention with the working-up of a feed hydrocarbon mixture which contain components boiling above 170° C., by subjecting this feed hydrocarbon mixture to a pre-distillation in which the components boiling at up to 169° C. under normal conditions are distillatively separated and then introduced into the extractive distillation, whereas the distillation residue is added to the aromate concentrate seving as blending component.

The process according to the present invention thus provides a pre-distillation of the feed hydrocarbon mixture in such manner that the resulting top product contains only those components which, upon the subsequent extractive distillation, do not cause any permanent contamination of the solvent. Higher boiling components, which can be separated from the solvent only with great difficulty or not at all, remain, in contrast, in the distillation residue (so-called sump product) of the pre-distillation stage, which is added according to the invention to the aromate concentrate serving as blending component. Herewith, one proceeds from the recognition that the composition of the reformate and platformate normally serving as feed mixture is such that, as a rule, non-aromatic compounds in the above-170° C.-boiling fraction are present not at all or only in very small amounts. Thus, for example, a typical reformate from petroleum refining displays a portion of about 3% by weight of higher boiling components having a boiling point of greater than 170° C., which according to the present invention remains in the distillation residue of the pre-distillation and which is added to the aromate concentrate serving as blending component. The composition of this higher boiling fraction is as follows.

HIGHER BOILING FRACTION REMAINING IN RESIDUE OF PRE-DISTILLATION

| Compound | Kp° C. | Weight-% |
|---|---|---|
| m-cymol | 175 | 3.4 |
| hemellitol | 176.1 | 14.3 |
| p-cymol | 177.1 | 12.3 |
| N-butylbenzene | 183 | 2.8 |
| indan | 177.8 | 9.9 |
| 1,2-diethylbenzene | 183.4 | 24.3 |
| durene | 196.8 | 4.7 |
| I-durene | 198 | 16.2 |
| tetraline | 207.6 | 0.1 |
| trimethylethylbenzene | 213 | 3.0 |
| naphthalene | 218 | 4.0 |
| methyltetraline | 229 | 0.1 |
| β-methylnaphthalene | 241 | 2.0 |
| α-methylnaphthalene | 245 | 1.2 |
| diphenyl | 255 | 0.8 |
| dimethylnaphthalene | 268 | 0.9 |

-continued

| HIGHER BOILING FRACTION REMAINING IN RESIDUE OF PRE-DISTILLATION | | |
|---|---|---|
| Compound | Kp° C. | Weight-% |
| | TOTAL | 100.0 |

The percentages given above refer not to the total amount of reformate, but to the composition of the fraction boiling above 170° C.

With the performance of the process according to the present invention, the pre-distillation stage can be operated with relatively low investment and operational expenditures (small plate number and low reflux ratio), since a sharp quantitative separation is not necessary in this case. Thus, for example, the operational conditions in the pre-distillation are indeed so adjusted that even a part of the o-xylene (Kp 144° C.) remains in the distillation residue of the pre-distillation, since even in this boiling range, normally only so little nonaromates are present in the feed hydrocarbon mixture that upon addition of these to the aromate concentrate serving as blending component, no noticeable disturbance results. It is moreover, to be considered herewith, that the non-aromate portion in the distillation residue of the pre-distillation stage is thereby decreased in that azeotropes between aromates and non-aromates leave predominantly in the top product of the pre-distillation, and thereby are subjected to the subsequent extractive distillation process. Thus, for example, the o-xylene forms an azeotrope with the n-nonane.

A particularly advantageous embodiment of the process of the invention is provided, when the pre-distillation is operated under increased pressure. Herewith, the pressure can be adjusted so that the pre-distillation is run at higher temperature than the extractive distillation, so that the top product vapors arising in the pre-distillation can be utiized for column heating in the extractive distillation, and the thereby produced condensate is introduced into the extractive distillation. The pre-distillation stage is herewith operated with a pressure up to 15 bar.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a schematic, flow chart representation of another embodiment of the process of our invention.

DESCRIPTION OF THE PREFERRED EMBODIMENTS

Figure 1:
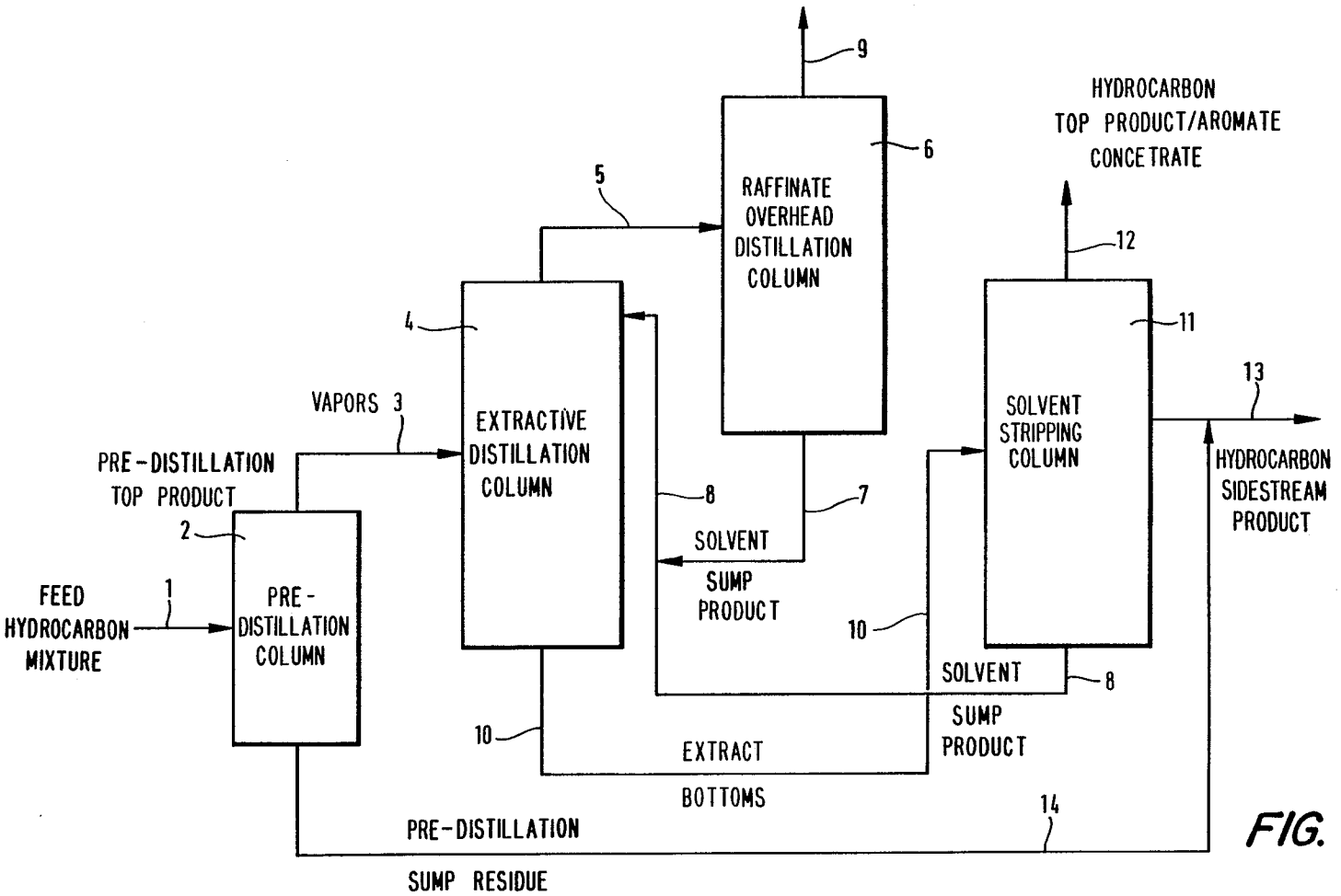
FIG. 1 is a schematic, flow chart representation for one embodiment of the process according to the present invention.

In the drawing FIG. 1, a feed hydrocarbon mixture is introduced for working-up initially by means of conduit 1 into distillation column 2, in which the pre-distillation according to the invention of the feed hydrocarbon mixture is performed. The top product thereby resulting is introduced by means of conduit 3 into the middle part of extractive distillation column 4, provided with built-in units or filler bodies. The hydrocarbons of the raffinate overhead escape at the top from the extractive distillation column and are led by means of conduit 5 into column 6, in which hydrocarbons of the raffinate overhead are distillatively separated from the solvent remainder. The latter is led by means of conduit 7 into conduit 8, through which the employed solvent is introduced into the upper part of extractive distillation column 4. The hydrocarbons of the raffinate overhead, freed of solvent, are discharged by means of conduit 9 from the top of the column 6 and led away for their particular further employment.

In another embodiment of our invention a condenser/heat exchanger 15 may be connected between the top of the predistillation column 2 and the middle part of the extractive distillation column 4 as shown in FIG. 2, so that top-product vapor from the column 2 passes through the condenser/heat exchanger 15 and reaches the extractive distillation column 4 in a completely condensed state. If an operating pressure for the predistillation is appropriately increased the predistillation may be performed at a temperature which is higher than that in the extractive distillation column 4 so that top-product vapor arising during predistillation is fed through the heat exchanger to provide heating for the extractive distillation column 4 and to condense the top-product vapor before it reaches the extractive distillation column 4.

The hydrocarbons of the extract bottoms together with the major portion of the solvent are discharged by means of conduit 10 from the sump of the extractive distillation column 4, and from there into the middle part of the solvent stripping column 11, which is likewise provided with built-in units or filler bodies. In this column, the hydrocarbons of the extract overhead, composed mostly of aromates, are driven off from the solvent, which concentrates in the sump of solvent stripping column 11, and then the recovered solvent is introduced by means of conduit 8 to the extractive distillation column 4. The hydrocarbons of the extract overhead, freed of solvent, are discharged, in contrast, by means of conduit 12 or conduit 13 from the solvent stripping column 11, and then introduced to their particular further use.

In the present case, the operational conditions of the extractive distillation column 4 are so adjusted, that the benzene contained in the feed hydrocarbon mixture concentrates extensively in the extract overhead, and a benzene-poor raffinate overhead is produced. Then, in the solvent stripping column 11, the benzene contained in the extract overhead is distillatively separated from the other aromates, and discharged by means of conduit 12 as top product, as marketable pure benzene with a non-aromate content of less than 1000 ppm, whereas an in this case, practically more or less benzene-free aromate concentrate is removed as a side stream by means of conduit 13 or by means of a side column disposed at this place but not shown in the Figure, from solvent stripping column 11. This aromate concentrate is then added to the distillation residue of the pre-distillation according to the invention. This distillation residue is discharged by means of conduit 14 from the sump of column 2 and admixed to the product stream flowing in conduit 13, so that the final product stream serving as blending component can be discharged by means of conduit 13.

The following possibilities also exist for performance of the process:

(a) In this case, the operational conditions of the extractive distillation column 4 are so adjusted, that a part of the benzene contained in the feed hydrocarbon mixture passes into the raffinate overhead, and there reamins in the aromatic concentrate of the extract bottoms only such a benzene content which does not exceed a desired maximum value, normally below 5% by weight. With the working-up of the extract bottoms in solvent stripping column 11, the produced aromate concentrate serving as blending component is discharged exclusively by means of conduit 12, while the side stream across conduit 13 goes out of operation.

(b) When, on the other hand, the benzene content in the feed hydrocarbon mixture is relatively low, and on the other hand, concentration of this benzene content in the aromate concentrate serving as blending component is not seen to be disturbing, then the extractive distillation column 4 can be driven under such operational conditions that the entire benzene content proceeds practically completely into the extract bottoms. In a divergence from the variation described above (a), in this case no separation of the benzene from the other aromates occurs in the solvent stripping column 11. That is, in this case, the aromate concentrate is discharged in its entirety by means of conduit 12 from the solvent stripping column 11, and the side stream by means of conduit 13 likewise remains out of operation.

It is self-evident that in both these variations, in a departure from the representation in the FIG. 1, the addition of the distillation residue from the pre-distillation stage goes to the aromate concentrate discharged by means of conduit 12.

The flow scheme represented in the FIG. 1 contains only such apparatus components unconditionally necessary for the illustration of the process according to the invention, whereas all additional arrangements which are not directly necessary in connection with the invention, have not been represented in the flow scheme. The applies in particular to the heat exchanger for heat exchange between the individual process streams, the circulation cooker for heating the individual columns, the arrangements for regeneration or supplementation of the consumed solvent as well as other measuring and regulating devices.

The effectiveness of the manner of operation according to the invention is substantiated by means of the following process example. This refers to the embodiment of the invention upon which the FIG. 1 flow scheme is based. The most important numerical values are summarized in the Table which follows. As feed product, a reformate from petroleum refining is employed, having a benzene content of 4.3% by weight.

TABLE

| Composition | cond. 1 feed-product pre-distill'n kg | cond. 3 top product pre-distill'n kg | cond. 9 raffinate kg | cond. 12 pure benzene kg | cond. 13 aromate concent. kg | cond. 14 sump product pre-distill'n kg | cond. 15 end product (blending component) kg |
|---|---|---|---|---|---|---|---|
| $C_4$–$C_7$-non-aromates | 221.9 | 221.9 | 221.9 | | | | |
| $C_8$-non-aromates | 54.9 | 54.7 | 52.3 | 1000 ppm | 2.4 | 0.2 | 2.6 |
| $C_9$-non-aromates | 17.5 | 6.1 | 3.1 | | 3.0 | 11.4 | 14.4 |
| $C_{10}$-non-aromates | 2.9 | 0.2 | | | 0.2 | 2.7 | 2.9 |
| benzene | 43.0 | 43.0 | 1.6 | 35.8 | 5.6 | — | 5.6 |
| toluene | 198.6 | 197.8 | 0.1 | | 197.7 | 0.8 | 198.5 |
| $C_8$-aromates | 240.1 | 65.2 | | | 65.2 | 174.9 | 240.1 |
| $C_9$-aromates | 191.1 | 7.1 | | | 7.1 | 184.0 | 191.1 |
| $C_{10}$-aromates | 30.0 | | | | | 30.0 | 30.0 |
| | 1000.0 | 596.0 | 279.0 | 35.8 | 281.2 | 404.0 | 685.2 |
| | % | % | % | % | % | % | % |
| Total aromates | 70.3 | 52.5 | 0.6 | | 98.0 | 96.5 | 97.1 |
| Total benzene | | | | 99.9 | | | 0.8 |
| Total non-aromates | 29.7 | 47.5 | 99.4 | 1000 ppm | 2 | 3.5 | 2.1 |
| ROZ | 93 | | | | 112 | | |

It will be understood that each of the elements described above, or two or more together, may also find a useful application in other types of processes differing from the types described above.

While the invention has been illustrated and described as embodied in a process for the production of an aromate concentrate suitable for use as blending component for gasifier fuels, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Improved process for production of an aromate concentrate for use as a blending component for gasification fuel, of the type employing a feed hydrocarbon mixture with a boiling range between 40° and 170° C., said feed hydrocarbon mixture containing a plurality of aromates as well as a plurality of non-aromates, whereby said feed hydrocarbon mixture is subjected to an extractive distillation using N-substituted morpholines, substituents of which display no more than seven carbon atoms, as selective solvent, in an extractive distillation column having a top and producing extract bottoms, and whereby a plurality of low-boiling non-aromates with a boiling range up to about 105° C. practically completely, and higher-boiling non-aromates with a boiling range between 105° and 160° C. to a major extent, are discharged as a raffinate overhead at said top of said extractive distillation column, whereupon said solvent is distillatively separated from a plurality of other hydrocarbons in said extract bottoms in a subsequently disposed solvent stripping column, said other hydrocarbons being employed at least partially as said bleeding component, the improvement wherein said process further comprises the step of predistilling another feed hydrocarbon mixture which contains components boiling above 170° C. in which the components that boil under normal conditions at up to 169° C. are distillatively separated as a predistillation top product and a distillation residue is also recovered as a predistillation sump product, introducing said pre-distillation top product to the extractive distillation column as the first-mentioned feed hydrocarbon mixture and adding the predistillation sump product to said other hydrocarbons employed as said blending component, wherein said other hydrocarbons include an aromate concentrate.

2. The process according to claim 1, wherein said pre-distillation is performed under increased pressure, said pressure being adjusted so that said pre-distillation is operated at a higher temperature than said extractive distillation, so that the top-product vapors arising during said pre-distillation are utilized in said extractive distillation, under complete condensation, for heating, and the condensate thereby produced is introduced into said extractive distillation.

3. The process according to claim 1, wherein said pre-distillation is operated with a pressure up to 15 bar.

* * * * *